US006261513B1

(12) United States Patent
Bernard et al.

(10) Patent No.: US 6,261,513 B1
(45) Date of Patent: Jul. 17, 2001

(54) DEVICE FOR DIRECTLY MONITORING THE CHARGING PROCESS ON THE INSIDE OF A SHAFT FURNACE

(75) Inventors: Gilbert Bernard, Helmdange; Emile Breden, Godbrange; Emile Lonardi, Bascharage; Guy Thillen, Diekirch, all of (LU); Pol Lemmer, Igel (DE); Aldo Bologna, Arlon (BE)

(73) Assignee: Paul Wurth, S.A., Luxembourg ( * ) Notice: Subject to any disclaimer, the term of this patent is extended or adjusted under 35 U.S.C. 154(b) by 0 days.

(21) Appl. No.: 09/355,518

(22) PCT Filed: Dec. 22, 1997

(86) PCT No.: PCT/EP97/07249

§ 371 Date: Feb. 7, 2000

§ 102(e) Date: Feb. 7, 2000

(87) PCT Pub. No.: WO98/32882

PCT Pub. Date: Jul. 30, 1998

(30) Foreign Application Priority Data

Jan. 29, 1997 (LU) ..... 90-013

(51) Int. Cl.[7] ..... C12D 11/00
(52) U.S. Cl. ..... 266/92; 266/99; 266/199
(58) Field of Search ..... 266/92, 93, 99, 266/199

(56) References Cited

U.S. PATENT DOCUMENTS 4,123,707 * 10/1978 Fujii et al. ..... 266/92
4,197,495 * 4/1980 Matsui et al. ..... 266/92
4,326,337 4/1982 Akimoto et al. ..... 33/174
4,858,892 8/1989 Kreuz et al. ..... 266/99
4,913,406 * 4/1990 Fukushima et al. ..... 266/92

FOREIGN PATENT DOCUMENTS 32 33 986 3/1984 (DE) .
0 291 757 11/1988 (EP) .
56-003606 1/1981 (JP) .
56-033412 3/1981 (JP) .
58-197207 11/1983 (JP) .
59-162211 9/1984 (JP) .
59-177310 10/1984 (JP) .
60-145306 7/1985 (JP) .
61-177304 8/1986 (JP) .
62-192511 8/1987 (JP) .
09235605 9/1997 (JP) .

OTHER PUBLICATIONS

Patent Abstracts of Japan, JP 09235605 Sep. 1997.*
Patent Abstracts of Japan, JP62192511 Aug. 1987.*
Patent Abstracts of Japan, JP56003606 Jan. 1981.*
Patent Abstracts of Japan, JP 61177304 Aug. 1986.*

* cited by examiner

*Primary Examiner*—Scott Kastler
(74) *Attorney, Agent, or Firm*—Smith, Gambrell & Russell

(57) ABSTRACT

A device for direct observation of the charging process inside a shaft furnace during its operation, in particular a blast furnace, with a measuring lance, which is arranged above the charge column in the shaft furnace in such a way that it is exposed to the charge material falling from a charging device during the charging process, and sensor means which detect the position of the falling charge material in relation to the measuring lance.

16 Claims, 7 Drawing Sheets

DEVICE FOR DIRECTLY MONITORING THE CHARGING PROCESS ON THE INSIDE OF A SHAFT FURNACE

The invention relates to a device for direct observation of the charging process inside a shaft furnace during its operation, in particular a blast furnace.

It is already known that the most uniform possible furnace charging is of crucial importance for optimum operation of a shaft furnace, e.g. a blast furnace. Hence in larger blast furnaces the conventional bell-type closing device has been replaced by bell-less throat closing devices with rotary chutes with angular adjustment, which allow selective build-up of the charge column in the blast furnace. To allow selective control of the build-up of the charge column in practice, the surface profile of the charge in the blast furnace is determined by special measuring equipment and the movements of the rotary chute with angular adjustment are controlled as a function of the determined surface profile.

In particular, measuring lances, which can be introduced radially into the blast furnace through a lateral opening in the shaft furnace wall above the charge column and have at least one profile probe for mechanical or contactless scanning of the charge surface, have been adopted in practice as measuring devices for determination of the surface profile of the charge. For example, a measuring lance with a plumb bob as the profile probe, which is secured to a wire rope running over a rotary drum, is already known from U.S. Pat. No. 4,326,337. The unreeled wire rope length when the plumb bob strikes the charge surface is measured. It is already known from DE-A-32 33 986 how to install an ultrasonic sensor in the plumb bob to scan the surface without contact and thus avoid penetration of the plumb bob in the charge surface. It is already known from EP-A-0291 757 how to install in the front end of the measuring lance a swivelling radar probe, which permits contactless scanning of the charge surface by radar waves.

To allow selective control of the build-up of the charge column with the aid of the determined surface profile, however, the charging characteristic (i.e. the trajectories) of the charging device for the respective charge material must be known. This charging characteristic is measured by means of tests with different charging parameters when a new charging device is commissioned and summarised in tables or mathematical models. However, this charging characteristic varies with time, e.g. due to erosion of the sliding surfaces in the charging device. Furthermore, it should be pointed out that a reliable charging characteristic is, of course, not -available for untested charge material or for varied charging parameters. The charging characteristic can, of course, be checked and/or supplemented when a furnace is shut down. During operation of the blast furnace, however, indirect conclusions concerning changes in the charging characteristic can be drawn only by comparisons of the determined surface profile with the pre-calculated surface profile. These conclusions are nevertheless extremely unreliable, because the determined surface profile is relatively inaccurate on the one hand and is staggered in time in relation to the charging process on the other. In fact reliable profile measurements can be made with the already known profile probes only in the intervals between charging and not during the charging process itself.

Hence the invention is based on the task of creating a device for direct observation of the charging process inside a shaft furnace, in particular a blast furnace, during its operation.

A device according to the invention comprises a measuring lance, which is arranged in such a way above the charge column in the shaft furnace that it is exposed during the charging process to the charge material falling from a charging device, and sensor means, which detect the position of the falling loose material in relation to the measuring lance. The measuring lance can accordingly be permanently arranged in the shaft furnace. In a preferred form of construction, however, the measuring lance—like already known measuring lances for the blast furnace—can be introduced radially into the shaft furnace through a lateral sealing device in the furnace wall above the charge column, whereby the measuring lance when introduced is exposed to the charge material falling from a charging device during the charging process. Hence with this measuring lance the trajectories of the charge material can be recorded during the charging process. Consequently changes in the charging characteristic of the charging device can be ascertained directly during furnace operation. These changes can be taken into account in the tables and/or mathematical models, which are used to control the charging device. Tables and/or mathematical models for charge material with new parameters can easily be compiled during furnace operation. This contributes significantly to optimisation of the charging of a blast furnace. Furthermore, changes detected in the charging characteristic permit conclusions to be drawn concerning wear (e.g. due to erosion of the sliding surfaces) in the charging device itself. The proposed device can be used, for example, to establish when the rotary chute in a bell-less throat closing device needs to be replaced. In this case the maintenance costs for the charging device are reduced and the furnace shutdown times for maintenance work can be shortened if necessary.

The sensor means advantageously comprise at least one impact sensor, which records the impact of pieces of charge material on the measuring lance. This impact sensor is advantageously designed as a position-resolving pressure sensor extending along the active area of the measuring lance, i.e. as a pressure sensor with which the point of impact of the charge material on the lance can be determined. It may be, for example, an interchangeable film pressure sensor, which has several separate active areas along the active area of the measuring lance. To prevent damage to the film pressure sensor by the falling material, the sensor is preferably covered by an elastomer material or enclosed in an elastomer body.

In a second embodiment the impact sensor is designed as a sound sensor. This advantageously comprises several resonance bodies arranged one behind the other in the longitudinal direction of the measuring lance and several sound conductors, a sound conductor extending inside the measuring lance from the respective resonance body to a rear end of the measuring lance outside the shaft furnace being assigned to each resonance body. At the rear end of the measuring lance a microphone, which picks up the sound generated by the resonance body and converts it into electrical signals, is assigned to each sound conductor.

In a further embodiment, the impact sensor incorporates several fluid cells arranged one behind the other in the longitudinal direction of the measuring lance, wherein each fluid cell can be supplied with a fluid via a fluid supply. Each fluid cell is accordingly a detector for detecting the change in fluid pressure in the fluid cell concerned. If a piece of charge material impacts on one of the fluid cells, a pressure shock occurs in that cell, which is detected by the detector allocated to that cell and converted into, for example, an electrical signal. The electrical signals produced by the various detectors are then evaluated in order to calculate the distribution of the impacting pieces of material on the measuring lance.

In a first, particularly simple variant of the fluid cells, each fluid cell forms an opening on the upper side of the measuring lance, through which the fluid can escape from the measuring lance, the opening of the fluid cell when impacted by a piece of charge material being capable of being closed at least partially by the piece of charge material. When a piece of charge material falls on to one of the openings, the flow of fluid through that opening is as a result briefly interrupted or at least significantly reduced. This leads to a brief rise in the static pressure in the fluid supply, which is detected by the detector. It should be noted that this variant of the fluid cell essentially incorporates a supply line for the fluid which extends through the interior of the lance and forms at its first end an opening in the outer surface of the measuring lance and is connected at its second end to the fluid supply.

In a second variant, each fluid cell incorporates a pressure chamber with a partially elastic wall, this partially elastic wall being directly exposed to the charge material during the observation process and reducing the volume of the pressure chamber when a piece of charge material falls on it. It should be noted in this connection that the partially elastic wall can be integrated into the outer surface of the measuring lance in one piece.

A piece of charge material failing on the partially elastic wall deforms this wall briefly in the direction of the pressure chamber, as a result of which the volume of the chamber is reduced. This reduction in the volume of the chamber in turn causes the fluid pressure in the chamber to rise briefly, and the resulting pressure shock is detected by the detector. Immediately after the impact, the partially elastic wall resumes its original shape under the effect of the elastic restoring force.

The advantage of this variant over the first variant of the fluid cell lies in the enlarged active surface of the individual fluid cell. Whereas the size of the active surface in the first variant is defined by the cross-section of the opening, which cannot be enlarged at will, the design as a pressure chamber enables the partially active wall to be adapted to virtually any desired local resolution capability. In addition, with the pressure chamber variant no opening formed in the outer surface of the measuring lance can be blocked by charge material.

The pressure chamber can additionally incorporate at least one outlet opening for the fluid in such a way that the fluid flows from the fluid supply through the pressure chamber to the outlet opening, thereby forming a flow channel, wherein the partially elastic wall reduces the cross-section of the flow channel when a piece of charge material falls on it. As a result, the flow resistance of the flow channel rises briefly and, as in the first variant of the fluid cells, a rise occurs in the static pressure in the fluid supply line. In this variant the pressure chamber is preferably designed in such a way that it has a very low height. In this way a very high response capability of the fluid cell is achieved, and the observed rise in pressure is significantly greater and more prolonged than the pressure shock with a closed pressure chamber.

The outlet opening for the fluid is preferably located inside the measuring lance. In this way the opening cannot be blocked by pieces of material. The emerging fluid is then conveyed, for example, via a return channel to the rear end of the measuring lance, where it can be re-used. It should be pointed out that the fluid can also be used, if required, as a coolant for the fluid cell.

In the pressure chamber of the fluid cell, a radial (in relation to the measuring lance, i.e. in the direction of the impact of the pieces of charge material) sliding piston is located, which limits the flow channel on the side facing the partially elastic wall. In operation, the piston "floats" on the flowing fluid and, in the event of an impact from a piece of charge material through the partially elastic wall, is accelerated in the direction of the flow channel so as to constrict it.

In order to avoid any undesired activation of the fluid cell due to vibrations of the measuring lance, the piston can be lightly pre-stressed by an elastic means, e.g. a coil spring, against the partially elastic wall. The elastic means can be located between the bottom of the pressure chamber and the piston, for example, and thus prevent the flow channel from being restricted due to vibrations of the measuring lance.

A particularly good response characteristic for the fluid cell can be achieved if the outlet opening(s) of the pressure chamber is (are) positioned and dimensioned in such a way that, when the piston is -displaced, it is (they are) completely closed by the said piston. If a piece of material falls on to the corresponding fluid cell, the escape of fluid from the pressure chamber is totally prevented and the measured pressure rise is at a maximum.

As, in the variants described above, the fluid cells cause the pressure change brought about by the impact of a piece of material to be directly detectable in the fluid supply line, the detector for detecting the change in fluid pressure in the fluid cell concerned can detect a pressure change in the fluid supply line. It is thus possible to locate the detector outside the measuring lance and to protect it from the high temperatures inside the shaft furnace.

To protect the sensor means from the falling material in the intervals between measurement, the device according to the invention advantageously has a protective sleeve, which encloses the measuring lance over a specific length and is movable by a drive in the longitudinal direction of the measuring lance between a protective position and an operating position, the protective sleeve covering the sensor means in the protective position and releasing it in the operating position.

To save costs it is advisable to incorporate at least a second measuring function in the measuring lance. For example, the measuring lance may additionally carry at least one measuring element for scanning the charge profile in the blast furnace and/or additionally be designed as a gas probe and/or temperature probe.

BRIEF DESCRIPTION OF THE DRAWING

An embodiment of the invention will now be described below with reference to the attached figures.

FIGS. 1 and 2 show a section through the charging area of a blast furnace 2, i.e. the area between the charge column 4 and the charging device, of which only the rotary chute 6 with angular adjustment is shown. The charge material 8 passes via a bunker (not shown) to the rotary chute 6 and is distributed by the latter over the charging surface 10. For this purpose the rotary chute 6 rotates about the vertical axis 0 of the blast furnace 2, the angle a between the rotary chute 6 and the vertical axis 0 being variable in such a way that optimum distribution over the entire charging surface 10 is achieved.

Figure 1:
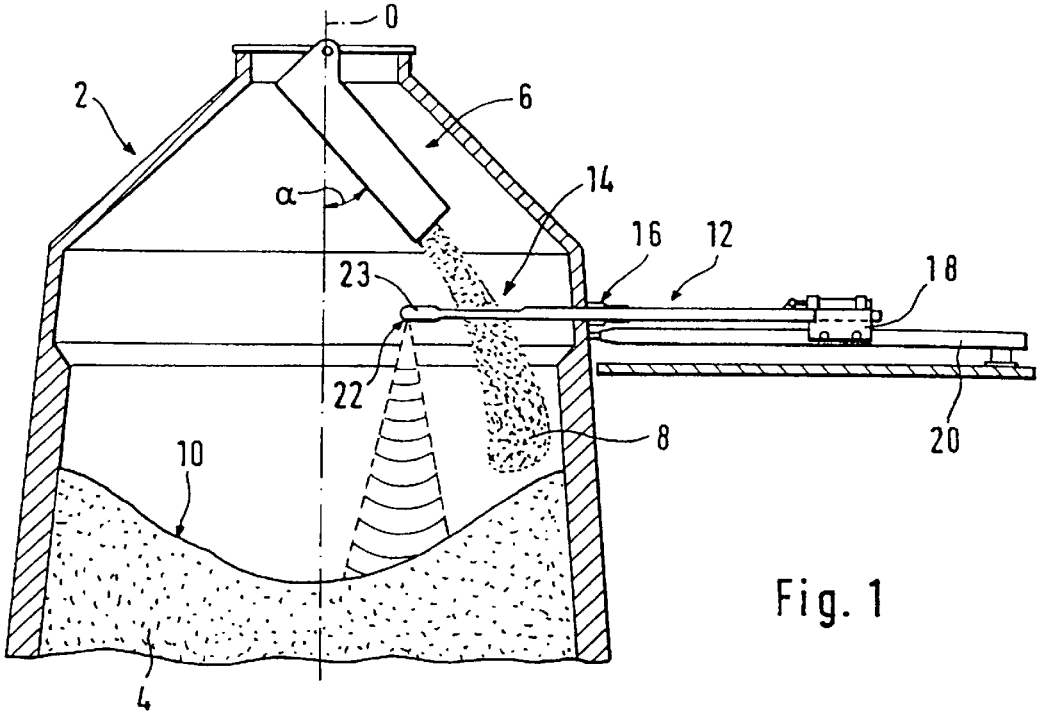
FIG. 1: shows an elevation of a first embodiment of a device according to the invention with a measuring lance which can be introduced laterally into a shaft furnace in a first measuring position for scanning the charging characteristic in the outer area of the shaft furnace.

To allow selective control of build-up of the charge column 4, the charging characteristic (i.e. the trajectories ) of the charging device for the respective charge material as a function of the angle of the adjustment $\alpha$ of the rotary chute 6 must be known. To record this charging characteristic a measuring lance 12, which is exposed to the charge material 8 falling from the rotary chute 6 during the charging process, is arranged laterally in the blast furnace 2 above the charge. This measuring lance 12 is consequently exposed to the falling jet of material 8 whenever the chute 6 rotates.

In its area exposed to the falling charge material 8 the measuring lance 12 has an impact sensor 14, which determines the position of the impact of the charge material on the measuring lance 12 when the charge material 8 passes over it. With the aid of the determined impact positions and if the exact position of the measuring lance 12 inside the blast furnace 2 is known, the trajectory for the respective angular adjustment of the rotary chute 6 can be calculated, e.g. by calculating the position of the highest density (centre of gravity) of the material jet 8. Knowledge of which area of charging surface 10 is charged at a specific angle of adjustment $\alpha$ is thus obtained.

It should be noted that the measuring lance 12 can be rigidly mounted on the blast furnace wall at its rear end, only supply lines for the impact sensor 14 and an envisaged cooling device being led through the blast furnace wall. In an advantageous embodiment the measuring lance 12 can advantageously be introduced radially from outside into the blast furnace 2, however, the rear end of the measuring lance 12 projecting from the blast furnace 2. For this purpose the measuring lance 12 is mounted at its rear end, for example, on a car 18, which runs on a rail 20 mounted outside the blast furnace 2 on its supporting frame. The lance is led through the furnace wall through a sealing device 16, e.g. an already known stuffing box.

Figure 2:
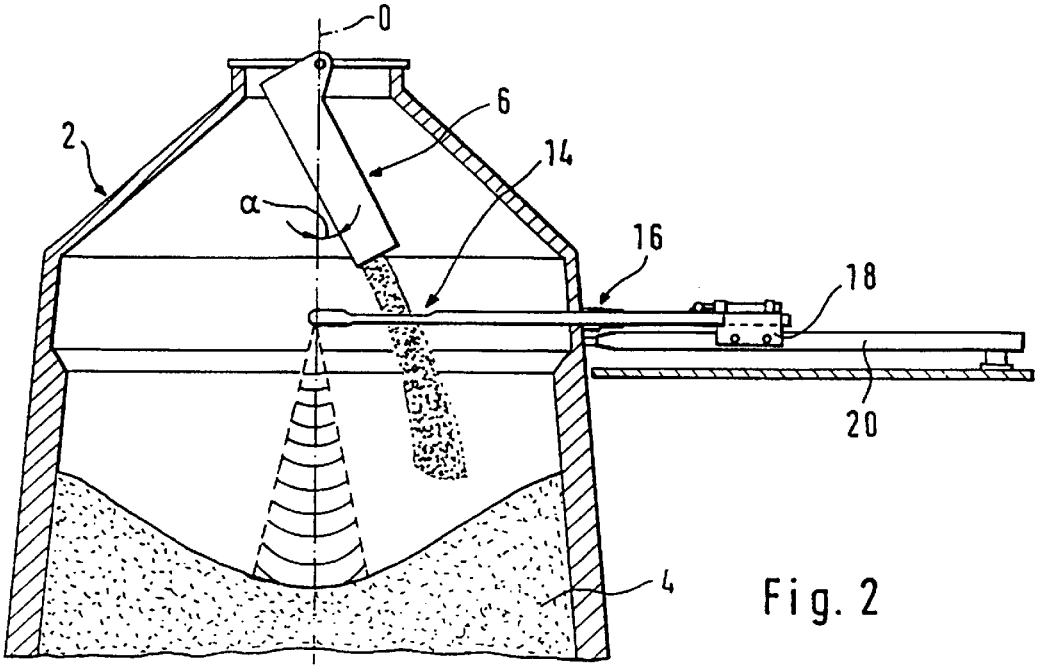
FIG. 2: an elevation of the device according to FIG. 1, in which the measuring lance assumes a second measuring position for scanning the charging characteristic in the inner area of the shaft furnace.

This form of construction permits withdrawal of the measuring lance 12 from the blast furnace 2 and thus permits easy access to the impact sensor 14, e.g. to change it when damaged. In addition an impact sensor 14 with a length only insignificantly greater than that of the material jet 8 can be used with this form of construction. With a fixed measuring lance 12 the active area of the impact sensor 14 must extend essentially over the full radius of the blast furnace 2 to allow exposure to the falling charge material 8 at different angles of adjustment $\alpha$ of the rotary chute 6. By contrast a movable measuring lance 12 can assume different positions in the blast furnace 2 for different angles of adjustment $\alpha$, so that the active area of the impact sensor 14 is exposed to the charge material 8. The measuring lance 12 can thus assume a slightly withdrawn position with regard to the blast furnace axis at a large angle of adjustment $\alpha$ (FIG. 1), whereas it is moved into its advanced end position at a small angle of adjustment $\alpha$ (FIG. 2). It should be noted that in this case a position transmitter (not shown), which indicates the exact position of the measuring lance 12, is advantageously provided on the measuring lance 12 or on the car 18.

To save costs it is advisable to incorporate at least a second measuring function in the measuring lance 12. In the described form of construction of the measuring lance 12 a radar probe 22 for scanning the charging surface 10, which is integrated in the lance tip 23, is involved. In alternative refinements, however, a temperature sensor and/or a gas probe can also be integrated in the measuring lance 12.

Figure 3A:
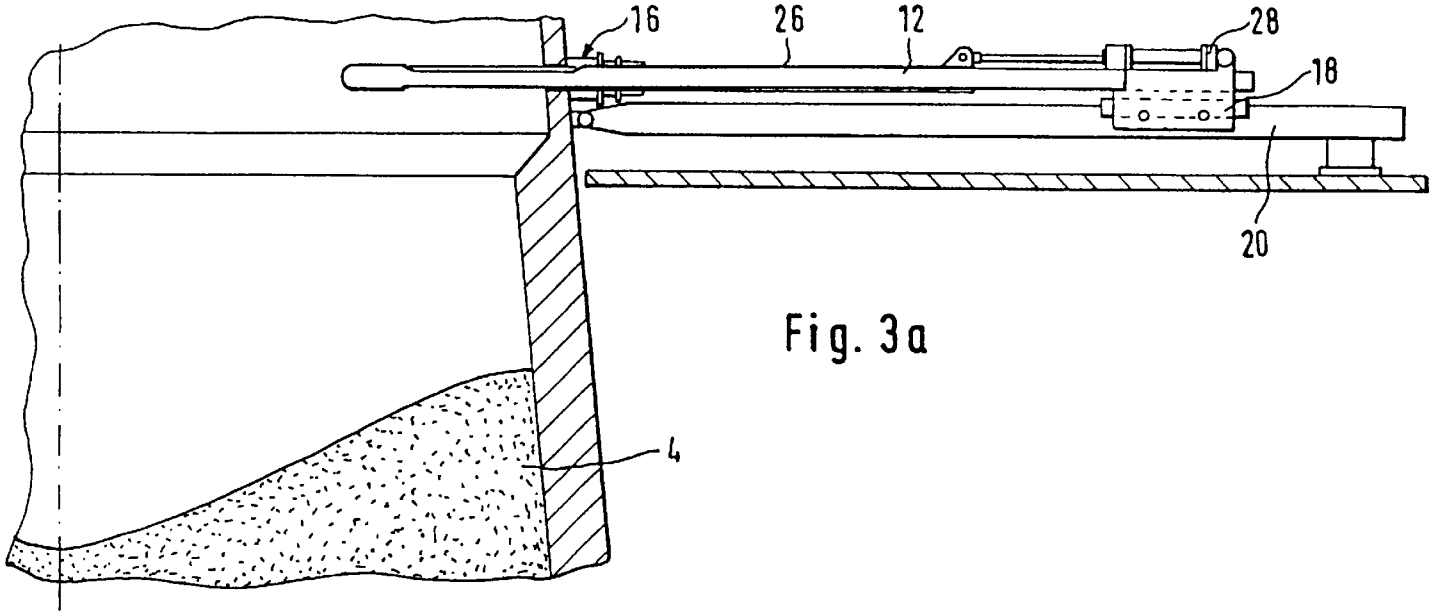
FIG. 3: a measuring lance which can be introduced laterally into the blast furnace, which is led through the blast furnace wall (a), and an advantageous embodiment of the measuring lance for this purpose (b and c)
Figure 3B:
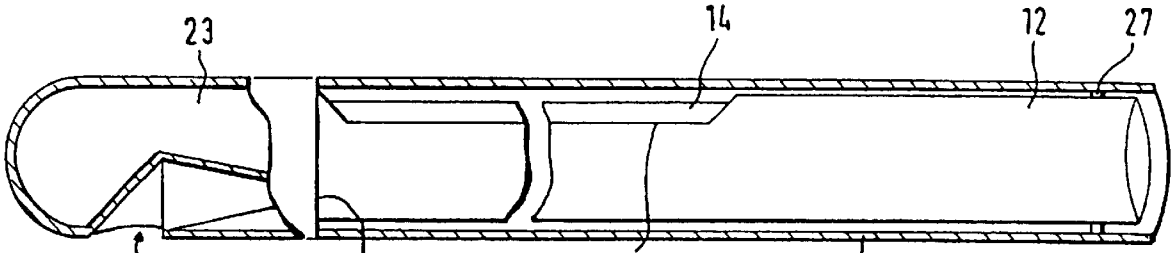
Figure 3C:
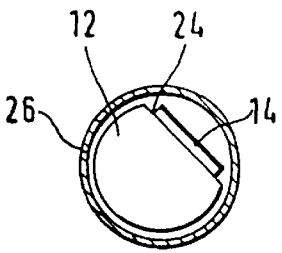

FIG. 3.*a*. shows a measuring lance 12, which can be introduced laterally into the blast furnace 2, on passage through the furnace wall and an advantageous embodiment of the measuring lance 12 for this purpose (b and c). The impact sensor 14 on the illustrated measuring lance 12 is mounted in a flat area 24 on the top side of the lance 12. To prevent charge material 8 accumulating on the impact sensor 14 the flat area 24 of the measuring lance 12 is not arranged horizontally but is inclined at 45°, for example, to the horizontal (see cross-section of the measuring lance 12 in c). Despite this inclination the impact sensor 14 is exposed to the charge material 8 falling from the rotary chute 6, but the material can no longer accumulate on the sensor.

Because of the different cross-section of the measuring lance 12 in the flat area 24 compared to the remaining areas with, for example, a circular or oval cross-section, problems occur when the-flat area 24 of the measuring lance 12 is led through the blast furnace wall. In fact the sealing function of the stuffing box 16 is no longer ensured when the flat area 24 is led through the wall. For this reason a sealing sleeve 26, which is movable axially on the measuring lance 12, has a cross-section corresponding to the measuring lance 12 and encloses the measuring lance 12 tightly over a specific length, is preferably provided, the gap between the measuring lance 12 and the sealing sleeve 26 being sealed on the outside by a suitable seal 27. The sealing sleeve 26 is movable in the longitudinal direction of the measuring lance 12 by a drive 28, e.g. a hydraulic cylinder mounted between the car 18 and the sealing sleeve 26, the latter in a first end position covering the flat area 24 with the impact sensor 14 mounted therein in such a way that the measuring lance 12 has a uniform cross-section in the longitudinal direction. For this purpose the lance tip 23 preferably has as far as the flat area 24 an outer cross-section which is identical to the outer cross-section of the sealing sleeve 26, whereas the remaining part of the measuring lance 12 has a cross-section which, apart from the flattening in the area 24, corresponds approximately to the inner cross-section of the sealing sleeve 26. At the transition between the lance tip 23 and the central section of the lance the lance consequently has a radial shoulder 30, on which the sealing sleeve 26 in its first end position rests in such a way that the measuring lance 12 has a uniform cross-section in this case. Consequently the tightness of the device is ensured during passage of the measuring lance 12 through the stuffing box 16 adapted to this outer cross-section. It should be noted that the length of the sealing sleeve 26 is selected in such a way that it maintains the tightness between the stuffing box 16 and the measuring lance 12 also in the end position of the measuring lance 12 inside the blast furnace 2.

Figure 4A:
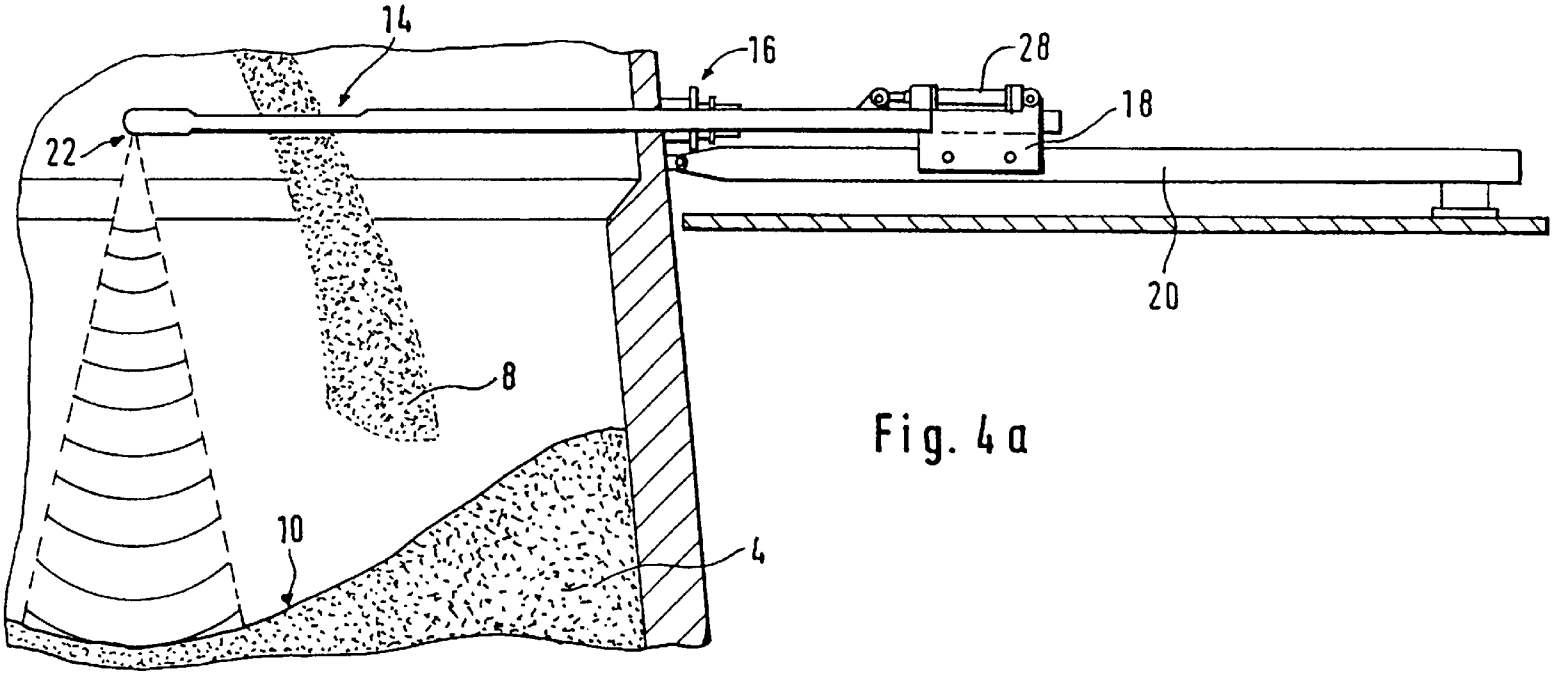
FIG. 4: similar representations to FIG. 3, the measuring lance in its measuring position being arranged inside the blast furnace.
Figure 4B:
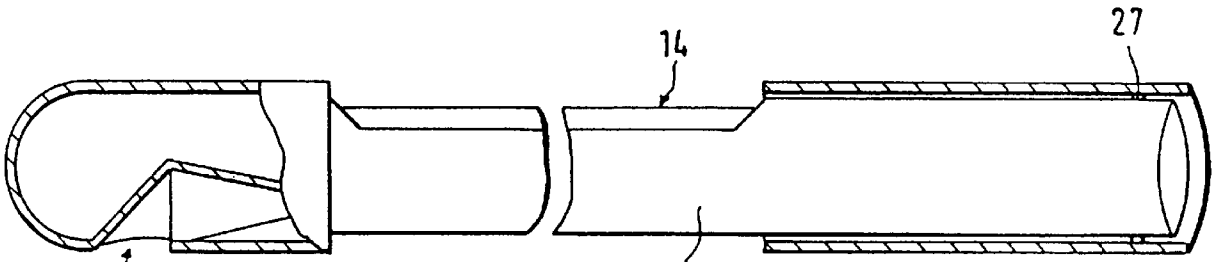
Figure 4C:
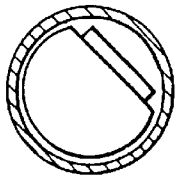

After introduction of the measuring lance 12 through the stuffing box 16 the sealing sleeve 26 is moved by the drive 28 from its first end position into a second end position, in which the flat area 24 of the measuring lance 12 is released (see FIG. 4). The impact sensor 14 is consequently exposed to the charge material 8 falling from the rotary chute 6 and the trajectories can be determined. It should be mentioned that the sealing sleeve 26 can also be used as a protective sleeve for the impact sensor 14. If the trajectories are not to be recorded for a certain time, the sealing sleeve 26 can be moved into its first end position, so that the impact sensor 14 is protected from the falling charge material 8.

The impact sensor 14 is preferably a position-resolving pressure sensor, which is advantageously enclosed in an elastomer body for protection against damage by the falling charge material 8. The pressure sensor is, for example, designed as a film pressure sensor with several separate active areas 30 (FIG. 5) along the measuring area of the measuring lance 12, the electrical resistance of which changes when it is struck by pieces of charge material. The film pressure sensor is preferably mounted so as to be interchangeable in the flat area 24 of the measuring lance 12, the connections for the electrical supply of the individual active areas running inside the measuring lance 12 and being led through the latter out of the blast furnace 2.

Figure 5:
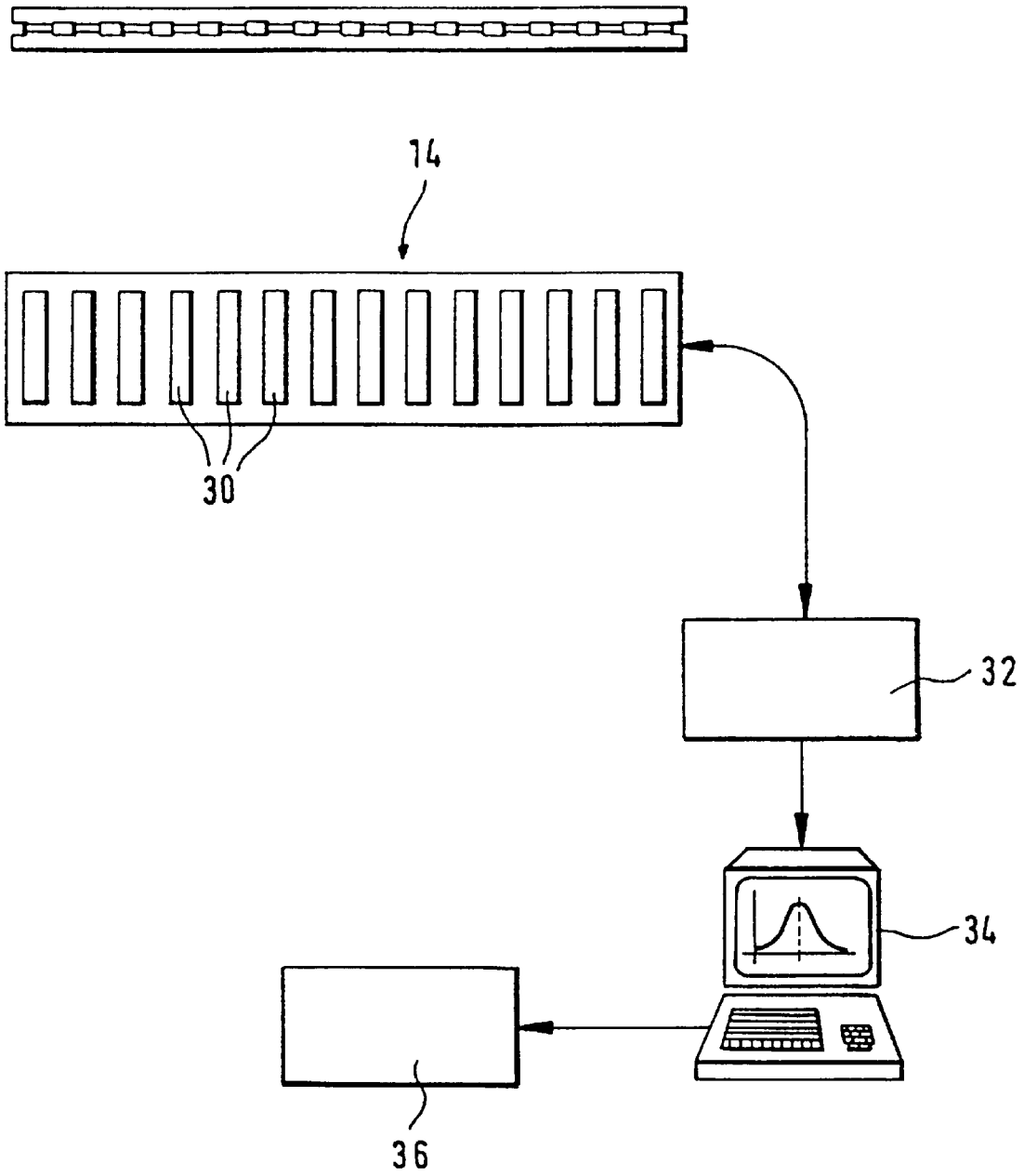
FIG. 5: a schematic representation of a control system for the charging device with a device according to the invention.

A control system for a charging device with a measuring lance 12 according to the invention is shown schematically in FIG. 5. The individual active areas 30 of the impact sensor 14 are connected via an electronic signal adapter 32 to a computer 34. When a piece of charge material strikes the sensor 14 the active areas 30 at the point of impact are activated and thus produce an electrical signal. These electrical signals are transmitted to the computer 34, in which the measured values are evaluated. The computer 34 calculates the trajectory of the charge material 8 from the signals of the activated sensor areas 30 and the position of the measuring lance 12 (position signal by position transmitter), e.g. by calculating the position of the highest density (centre of gravity) of the jet of material 8, and compares this with a stored setting value for the angle of adjustment a at a given moment. In the case of deviations of the measured value from the setting value, e.g. as a result of wear of the sliding surfaces in the rotary chute 6, i.e. if the area of the charge surface 10 aimed at with angle of adjustment $\alpha$ at a given moment is no longer charged, the computer calculates a correction value for the angle of adjustment of the rotary chute 6, which is then transmitted via a data interface to the control system 36 for the angular adjustment of the rotary chute 6.

Measurements of this type are now made for the different angles of adjustment $\alpha$ during a complete cycle of furnace charging. The measured changes and the calculated correction values can then be taken into account in the tables and/or mathematical models which are used to control the charging device. The changed angles of adjustment $\alpha$ can subsequently be checked in one of the following runs. These changed values are advantageously checked by fresh determination of the trajectories and also by scanning the charge surface 10 with the radar probe 22.

Figure 6:
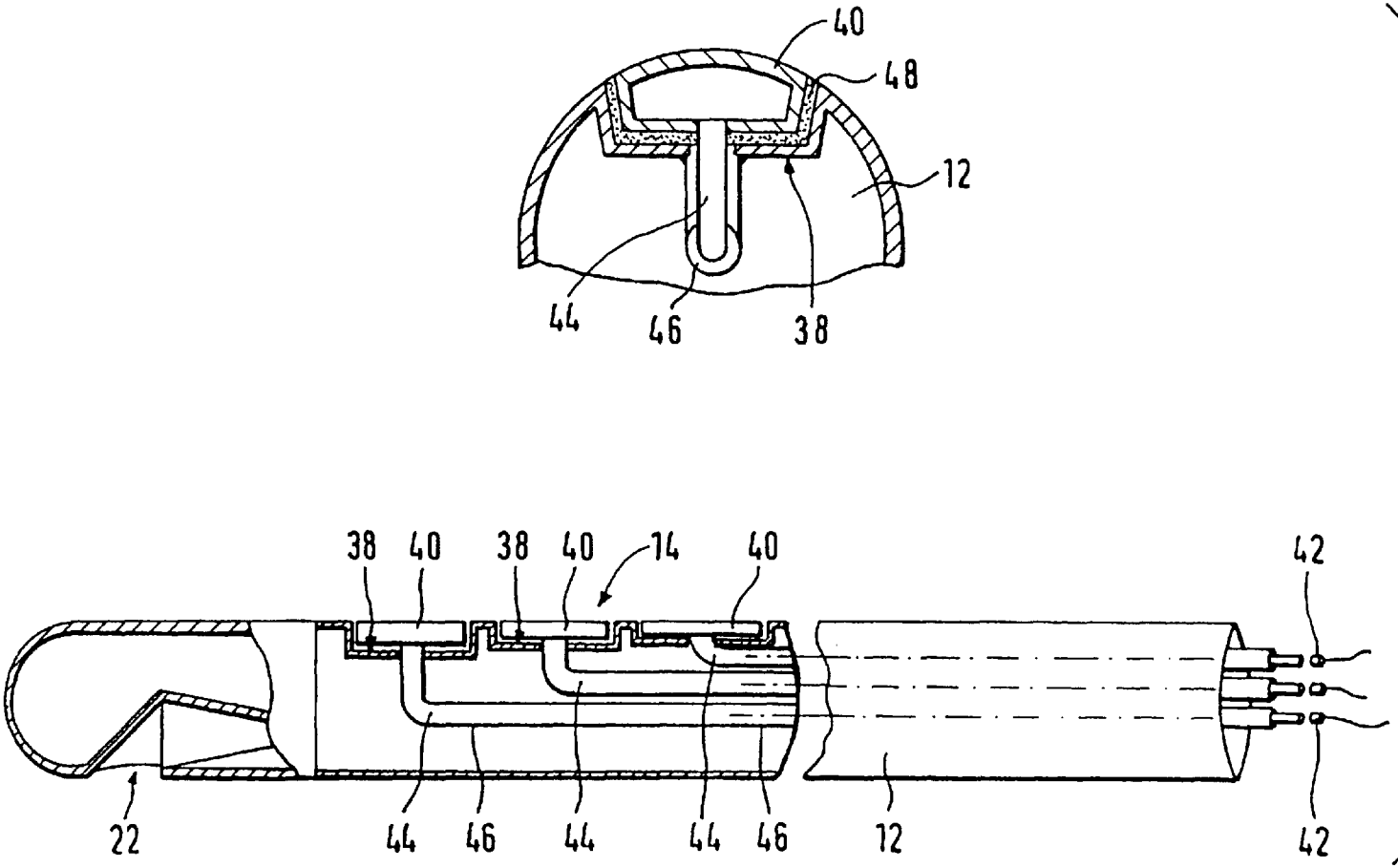
FIG. 6: a second advantageous refinement of the measuring lance with a sound sensor as the impact sensor.

FIG. 6 shows a further embodiment of a measuring lance 12 according to the invention. In this form of construction the impact sensor 14 is designed as a sound sensor. The measuring lance 12 has several recesses 38 on its upper side, which receive resonance bodies 40 and are arranged next to each other in the longitudinal direction, . The resonance bodies 40 are designed as hollow boxes, the shape of which is adapted to the recesses 38 in the measuring lance 12. When a piece of material strikes one of the resonance bodies 40, the latter produce vibrations with a specific resonance frequency. The sound produced in this way can then be converted, e.g. by means of a microphone 42 assigned to the resonance body 40, into an electrical signal, which is transmitted to the electronic signal adaptor 32 of the control system of the charging device. The microphones 42 assigned to the resonance bodies 40, can be arranged inside the measuring lance 12 immediately below the respective resonance body 40. Because of the high temperatures inside the blast furnace 2, however, they are preferably arranged outside the blast furnace 2 at the rear end of the measuring lance 12. In this case the sound of each resonance body 40 is transmitted via a sound conductor 44 assigned to it to the respective microphone 42. For this purpose the sound conductors 44 advantageously extend inside the measuring lance 12 from the underside of a resonance body 40 to the microphone 42 assigned to the resonance body 40 at the rear end of the measuring lance 12.

The sound conductors 44 preferably run with vibration isolation in a duct 46 made from elastomer material, so that mutual influencing of the different sound conductors 44 and influencing of individual sound conductors by the measuring lance 12 can be prevented. Similarly, the resonance bodies 40 are also mounted with vibration isolation in the recesses 38 of the measuring lance 12, e.g. by an interlayer 48 made from elastomer material which is placed between each resonance body 40 and the respective recess 38.

It should be mentioned that the shape of the resonance bodies 40 on their top side can be adapted to the shape of the measuring lance 12 in the areas without recesses, so that the use of a sealing sleeve is unnecessary in this embodiment.

Figure 7:
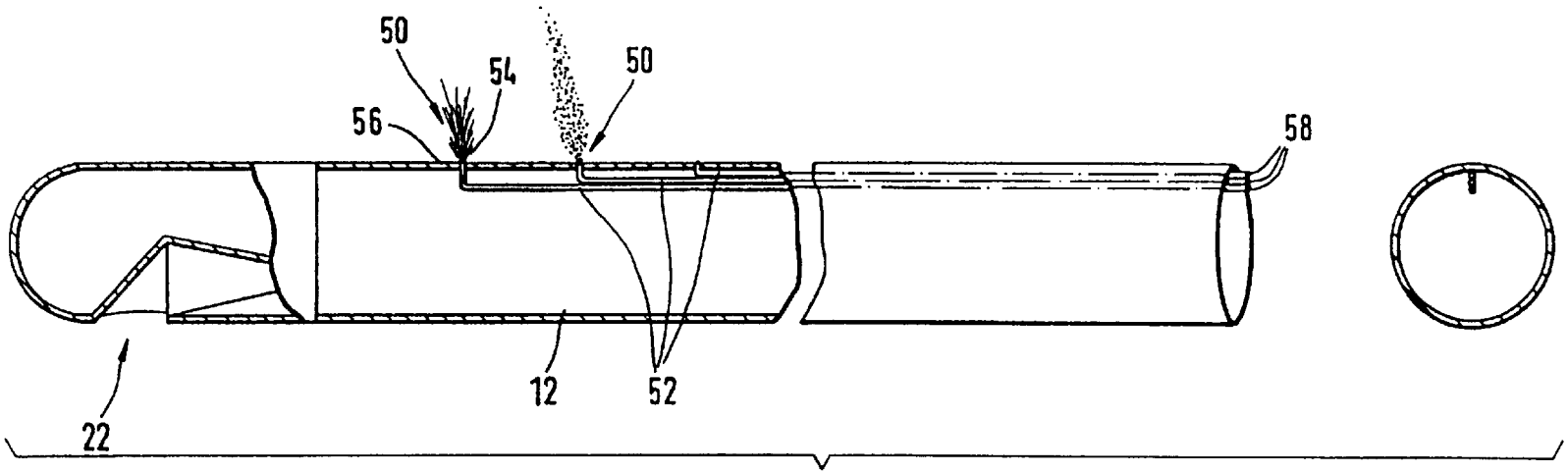
FIG. 7: an embodiment of the measuring lance with fluid cells for converting an impact into a pressure rise.

In FIG. 7 an embodiment of the measuring lance 12 is shown, in which the sensor means comprise several devices 50 arranged one behind the other in the longitudinal direction of the lance 12 for the generation of a pressure change in a fluid (so-called fluid cells), as well as detectors for detecting the relevant pressure changes. In the embodiment shown, the measuring lance 12 incorporates several gas lines 52 for this purpose, which extend through the measuring lance 12 and form at the first end of each of them an opening 54 in the outer surface 56 of the measuring lance and are connected at their second end 58 to a gas supply (not shown). In operation the gas lines 52 are charged continuously with gas under pressure, so that a flow of gas emerges from the measuring lance 12 at the relevant openings 54. If a piece of charge material falls on one of the openings 54, the latter is closed at least partially for a brief period of time and the gas flow emerging from the relevant opening 54 is significantly affected as a result. This leads to a brief rise in the static pressure in the gas supply line, which is detected by a detector (not shown). The detector incorporates, for example, a pressure-measuring instrument which is located at the rear end of the measuring lance 12 in the relevant gas line 50 in order to measure at that point the static pressure in the gas supply line concerned.

Instead of an open system, in which a gas flows into the shaft furnace, each of the devices 50 for generating a pressure change in a fluid can also incorporate a system which is closed in relation to the shaft furnace. Various embodiments of this kind are shown in the FIGS. 8 to 13.

Figure 8:
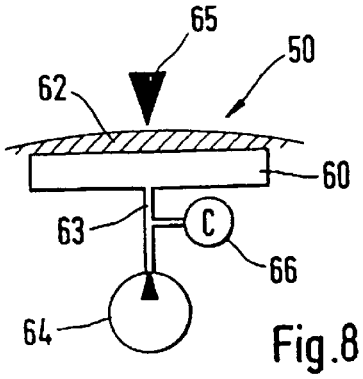
FIG. 8, FIG. 9, FIG. 10, FIG. 11 and FIG. 12: various embodiments of the fluid cells.

In the embodiment shown in FIG. 8, each fluid cell possesses a pressure chamber 60 with at least one partially elastic wall 62. The partially elastic wall 62 is turned to face the outer surface of the measuring lance 12 or integrated in the outer surface of the measuring lance 12 in one piece in such a way that it is directly exposed to the charge material during the observation process. The pressure chamber 60 is charged with a gas by a gas pump 64 via a gas supply line 63.

A piece of charge material falling on the partially elastic wall 62 (shown schematically by the wedge shape 65) briefly distorts the wall 62 in the direction of the pressure chamber 60, thus reducing the volume of the chamber. The reduction of the volume of the chamber in turn causes the gas pressure in the chamber 60 to rise briefly, and the resulting pressure shock is detected by the detector 66. Immediately after the impact the partially elastic wall 62 resumes its original shape under the influence of its elastic rebound capability.

It should be noted that the shape and size of the pressure chamber 60 and of the partially elastic wall 62 are adapted to the desired local resolution characteristics in each individual case.

Figure 9:
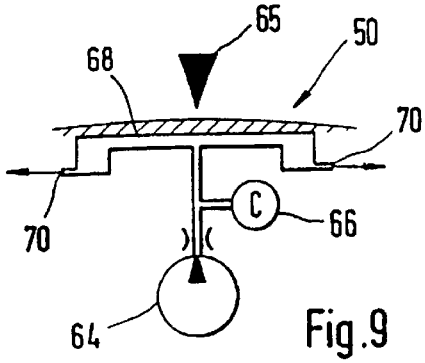

In the embodiment in FIG. 9 the pressure chamber takes the form of a flow chamber 68. To this end it incorporates at least one outlet opening 70 for the gas, so that the gas flows from the gas supply line 63 through the flow channel 68 to the outlet opening 70. When a piece of charge material 65 falls on the partially elastic wall 62, in this embodiment the cross-section of the flow channel 68 is reduced. As a result, the flow resistance of the flow channel 68 rises briefly, leading to an increase in the static pressure in the gas supply line 63.

The outlet openings 70 for the gas are preferably located inside the measuring lance 12. In this way the opening cannot be blocked by pieces of material. The escaping gas is then conveyed via a return channel (not shown), for example, to the rear end of the measuring lance 12, where it can be re-used. It should be noted that the fluid can also be used, if appropriate, as a coolant for the fluid cell 50.

Figure 10:
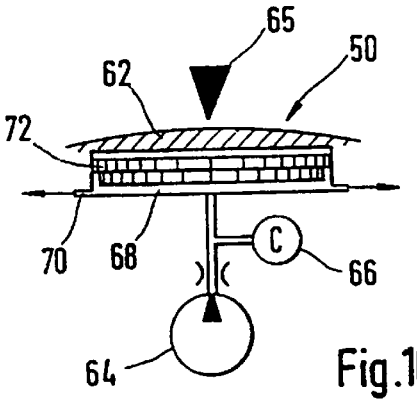

In the pressure chamber of the fluid cell 50, a piston 72, which can slide in the direction of the impact of the pieces of charge material, can advantageously be arranged, which limits the flow channel 68 on the side facing the partially elastic wall 62 (see FIG. 10). In operation, the piston 72 "floats" on the flow of gas through the flow channel 68 and, in the event of an impact from a piece of charge material 65 through the partially elastic wall, is accelerated in the direction of the flow channel 68 so as to constrict it.

Figure 11:
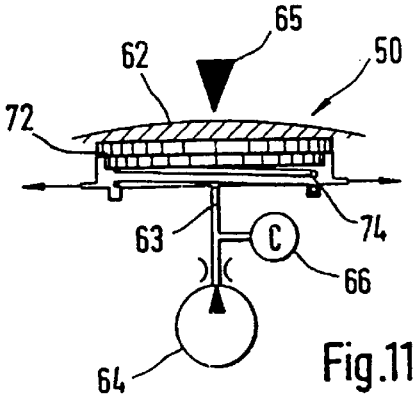

In order to avoid any undesired activation of the fluid cell 50 due to vibrations of the measuring lance 12, the piston 72 can be lightly pre-stressed by an elastic means, e.g. a coil spring 74, against the partially elastic wall 62. An embodiment of this type is shown in FIG. 11.

Figure 12:
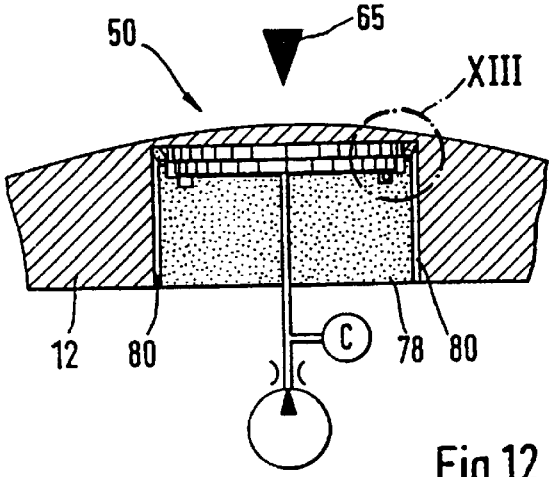
Figure 13:
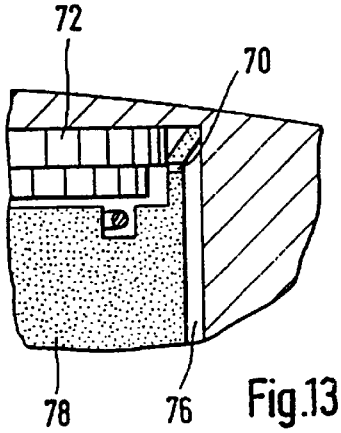
FIG. 13: an enlarged section from FIG. 12.

A particularly good response characteristic of the fluid cell 50 can be achieved with the embodiment shown in FIG. 12. In this variant the outlet openings 70 are positioned in the upper region of the pressure chamber 60 (see also FIG. 13) in such a way that, when the piston 72 is displaced, they are completely closed by the said piston. If a piece of material 65 falls on to the corresponding fluid cell 50, the escape of gas from the pressure chamber 60 is thereby totally prevented, and the measured pressure rise is at a maximum.

FIG. 12 also shows a possible method of manufacturing the pressure chamber and the flow channel. In this, an insert 78, which limits the pressure space 60 or the flow channel 68 radially on the inside, is fitted in a recess 76 running inside the measuring lance 12 in the radial direction to just beneath the outer surface. The radial position of the insert 78 is preferably adjustable, so that the volume of the pressure chamber or the cross-section of the flow channel can be set to the setting value.

The insert 78 is furthermore preferably made in such a way that gas guidance channels 80 are formed on the outside of the insert 78, through which the gas escaping from the outlet openings 70 is directed into the inside of the measuring lance to the return channel (not shown).

It should be noted that, with regard to the fluid cells shown in FIGS. 8 to 13, the detector 66 and the gas pump 64 are generally located outside the measuring lance, with their individual gas supply line 63 extending through the measuring lance 12 to its rear end.

What is claimed is:

1. Device for direct observation of a charging process inside a shaft furnace during a charging process operation, wherein said charging process comprises a charging of charging material onto a charge column inside the shaft furnace by means of a charging device, said device for direct observation comprising a measuring lance with several pressure chambers, said pressure chambers being arranged one behind another in a longitudinal direction of said measuring lance, each pressure chamber comprising an at least partially elastic wall, wherein said measuring lance can be introduced into the shaft furnace above the charge column through a lateral sealing device in a shaft furnace wall in such a way that said partially elastic wall is directly exposed to the charge material falling from the charging device, and wherein a detector is allocated to each pressure cell so as to detect a pressure change in said pressure chamber.

2. Device according to claim 1, wherein said pressure chamber is designed as a flow channel connected to a fluid supply line and comprising a fluid outlet opening, said pressure chamber being charged with a pressure fluid via said fluid supply line so that the fluid flows from the fluid supply line through the pressure chamber to the outlet opening, said partially elastic wall reducing the cross-section of said flow channel when charging material falls onto said elastic wall.

3. Device according to claim 2, further comprising a radially displaceable piston, said piston being arranged in the pressure chamber and limiting the flow channel on a side facing the partially elastic wall.

4. Device according to claim 3, further comprising biasing means arranged inside said pressure chamber for biasing said piston against said partially elastic wall.

5. Device according to claim 2, wherein said detector for detecting a pressure change in said pressure chamber detects a pressure change in the fluid supply line.

6. Device according to claim 2, further comprising a protective sleeve, which encloses the measuring lance over a specific length, said protective sleeve being movable in the longitudinal direction of the measuring lance between a protective position and an operating position by a drive, the protective sleeve covering said pressure chambers in the protective position and releasing said pressure chambers in the operating position.

7. Device according to claim 6, wherein said protective sleeve is designed as a sealing sleeve, the outer cross-section of the sealing sleeve being adapted to the sealing device and a sealing element being arranged between the sealing sleeve and the measuring lance.

8. Device according claim 1, wherein said measuring lance additionally comprises at least one measuring element for scanning a profile of said charge column.

9. Device according to claim 1, wherein said measuring lance is additionally designed as a gas probe.

10. Device according to claim 1, wherein said measuring lance is additionally designed as a temperature probe.

11. Device according to claim 1, wherein said shaft furnace is a blast furnace.

12. Device for direct observation of the charging process inside a shaft furnace during a charging process operation, wherein said charging process comprises a charging of charging material onto a charge column inside the shaft furnace by means of a charging device, said device for direct observation comprising a measuring lance which can be introduced into the shaft furnace above the charge column through a lateral sealing device in a shaft furnace wall, said measuring lance comprising several pressure chambers having an at least partially elastic wall, said partially elastic wall being arranged so as to be directly exposed to the charge material during an observation process, and a radially displaceable piston located in the pressure chamber, said piston being biased against said partially elastic wall by means of an elastic means.

13. Device according to claim 12, wherein said measuring lance is additionally designed as a gas probe.

14. Device according to claim 12, wherein said measuring lance is additionally designed as a temperature probe.

15. Device for direct observation of the charging process inside a shaft furnace (2) during its operation, in particular a blast furnace, characterised by a measuring lance (12), which can be introduced into the shaft furnace (2) above the charge column (4) through a lateral sealing device (16) in the shaft furnace wall in such a way that it is exposed to the charge material (8) falling from a charging device (6) during the charging process, and sensor means (14), which detect the position of the falling charge material (8) in relation to the measuring lance (12), and said measuring lance (12) being additionally designed as a gas probe.

16. Device for direct observation of the charging process inside a shaft furnace (2) during its operation, in particular a blast furnace, characterised by a measuring lance (12), which can be introduced into the shaft furnace (2) above the charge column (4) through a lateral sealing device (16) in the shaft furnace wall in such a way that it is exposed to the charge material (8) falling from a charging device (6) during the charging process, and sensor means (14), which detect the position of the falling charge material (8) in relation to the measuring lance (12), said measuring lance (12) being additionally designed as a temperature probe.

* * * * *